US006792241B2

(12) United States Patent
Nakagawa et al.

(10) Patent No.: US 6,792,241 B2
(45) Date of Patent: Sep. 14, 2004

(54) SHEET FEEDING APPARATUS, IMAGE SCANNING APPARATUS AND IMAGE FORMING APPARATUS PROVIDED WITH THE IMAGE READING APPARATUS

(75) Inventors: Daigo Nakagawa, Ibaraki (JP); Toshiyuki Takano, Ibaraki (JP); Yasushi Ishida, Ibaraki (JP); Masakatsu Yamada, Ibaraki (JP); Shigeyuki Sugiyama, Kanagawa (JP); Takuma Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/198,959

(22) Filed: Jul. 22, 2002

(65) Prior Publication Data

US 2003/0026633 A1 Feb. 6, 2003

(30) Foreign Application Priority Data

Jul. 31, 2001 (JP) ..... 2001/232581

(51) Int. Cl.[7] ..... G03G 15/00; B65B 3/06

(52) U.S. Cl. ..... 399/367; 271/117

(58) Field of Search ..... 399/361, 367, 399/391, 393; 271/10.01, 18, 42, 109, 117, 118, 121, 124, 162, 264

(56) References Cited

U.S. PATENT DOCUMENTS 4,822,023 A * 4/1989 Miyoshi ..... 271/118
5,348,283 A 9/1994 Yanagi et al. ..... 271/127
5,370,380 A 12/1994 Suzuki et al. ..... 271/21
5,580,042 A 12/1996 Taniguro et al. ..... 271/274
5,620,174 A 4/1997 Taniguro et al. ..... 271/10.12
5,648,808 A 7/1997 Yanagi et al. ..... 347/104
5,672,019 A 9/1997 Hiramatsu et al. ..... 400/624
5,725,319 A 3/1998 Saito et al. ..... 400/629
5,819,152 A * 10/1998 Kobayashi et al. ..... 399/367
5,895,039 A * 4/1999 Kato et al. ..... 271/124
5,915,684 A 6/1999 Nakagawa et al. ..... 271/110
6,131,898 A * 10/2000 Hiroi et al. ..... 271/118 X
6,547,235 B2 * 4/2003 Higaki ..... 271/10.01
6,554,270 B2 * 4/2003 Yamamoto ..... 271/117

* cited by examiner

*Primary Examiner*—Sandra L. Brase
(74) *Attorney, Agent, or Firm*—Fitzpatrick, Cella, Harper & Scinto

(57) ABSTRACT

An image feeding apparatus for feeding sheets by separating sheets one by one by a separating device has a pickup arm and a stopper. The uppermost document of stacking documents to be copied contacts and downwardly press down the pickup arm, and then the pickup arm and the uppermost document downwardly press down the stopper so as to make a passage of the uppermost document. After the uppermost document passes through, the stopper ascents by gravity in response to elevation of the pickup arm. The stopper can be reliably operated by a simple and low-cost construction.

16 Claims, 9 Drawing Sheets

SHEET FEEDING APPARATUS, IMAGE SCANNING APPARATUS AND IMAGE FORMING APPARATUS PROVIDED WITH THE IMAGE READING APPARATUS

BACKGROUND OF THE INVENTION

1. Field of the Invention

This invention relates to a sheet feeding apparatus, an image scanning apparatus and an image forming apparatus provided with the image scanning apparatus, and particularly to a stopper member for abutting against a sheet placed on a sheet stacking tray and blocking the entry of the sheet into a separating part.

2. Description of Related Art

Some of conventional image reading apparatuses such as copying machines and facsimile apparatuses are provided with a document feeding apparatus for feeding documents (originals) placed on a document (original) stacking standby document feeding means, and thereafter separating them one by one by a separating part and feeding them to an image scanning part. As such a document feeding apparatus, there is, for example, one having a sheet feeding apparatus provided with document feeding means for feeding documents which are sheets, and a separating part.

FIG. 10 of the accompanying drawings shows the construction of a conventional sheet feeding apparatus provided in such a document feeding apparatus, and in this sheet feeding apparatus, a pickup roller 73 for feeding documents S is held by the movable end portion of a pivotally supported pick up arm 71. The pickup arm 71 is pivotally supported with the drive shaft 71*a* of a separation roller 74 for separating the documents S fed by the pickup roller 73 one by one as a fulcrum. The separation roller 74 is in pressure contact with a separation pad 75, and this pressure contact part (nip part) constitutes a separating part for separating the sheets.

The reference numeral 70 designates a stopper member pivotally supported by the pickup arm 71, and this stopper member 70 is held in a state shown in the figure by its upper end abutting against the cover member 72 of the document feeding apparatus during standby. Design is made such that when the stopper member 70 is in such a state, the leading edge of the document S abuts against the stopper member 70 and does not enter the separating part.

When the document S is to be fed, the pickup arm 71 descends in the direction of arrow Y, whereby the pickup roller 73 held by the pickup arm 71 contacts with the document S and is rotated to thereby feed the document S. On the other hand, the abutment of the stopper member 70 against the cover member 72 is released in operative association with the descent of the pickup arm 71, and therewith, the stopper member 70 becomes pivotally movable in a counter-clockwise direction along a guide groove 76. Since the stopper member 70 is pivotally movable as described above, the stopper member 70 is pushed and pivotally moved by the leading edge of the document S fed by the pickup arm 71 and the document S enter the separating part. In this manner, the documents S are fed by the pickup roller 73, and are separated one by one by the separating part constituted by the separation roller 74 and the separation pad 75.

However, when in such a conventional sheet feeding apparatus, for example, the pickup arm 71 is not fixed, if the stopper member 70 is pressed in the direction of arrow Z by the documents when the documents are set in the standby state shown in the figure, the upper surface of the stopper member 70 will come to press the cover member 72.

When the stopper member 70 thus presses the cover member 72, the pickup arm 71, which is not fixed, is depressed in the direction of arrow Y and as a result, there has occurred the inconvenience that the stopper member 70 is released.

In order to prevent such an inconvenience, in case that the pickup arm 71 is designed not to be vertically moved when, for example, the documents S are set, the driving construction of the pickup arm 71 has become complicated and this has led to an increase in cost. Also, there have been many limitations for applying such a construction.

SUMMARY OF THE INVENTION

So, the present invention has been made in view of such present situation and has as its object to provide a sheet feeding apparatus and an image scanning apparatus in which a stopper member can be operated simply and at a low cost and reliably and an image forming apparatus provided with the image scanning apparatus.

The present invention provides a sheet feeding apparatus for feeding sheets supported on sheet supporting means by sheet feeding means, and separating and feeding the fed sheets one by one by separating means, the sheet feeding apparatus being provided with holding means for moving the sheet feeding means between a sheet feeding position wherein the sheet feeding means abuts against the sheets supported on the sheet supporting means and a standby position wherein the sheet feeding means is spaced apart from the sheets, and stopper means for abutting against the leading edges of the sheet supported on the sheet supporting means, and blocking the entry of the sheets into the separating means, wherein when the holding means is moved to make the sheet feeding means abut against the sheets supported on the sheet supporting means, the stopper means is pressed and moved by the holding means, and after the stopper means has been moved by the holding means, the stopper means is pressed and further moved by the sheets fed by the sheet feeding means to thereby make the passage of the sheets possible.

The present invention also provides a sheet feeding apparatus for feeding sheets placed on a sheet stacking tray by a pickup roller, and separating and feeding the fed sheets one by one by a separation roller and a separation pad, the sheet feeding apparatus being provided with a pickup arm on which the pickup roller is mounted and which is moved between a sheet feeding position wherein the pickup roller abuts against the sheets supported on the sheet stacking tray and a standby position wherein the pickup roller is spaced apart from the sheets, and a stopper for abutting against the leading edges of the sheets supported on the sheet stacking tray to block the entry of the sheets into the separation pad, the stopper being provided with an abutting portion against which the leading edges of the sheets supported on the sheet stacking tray abut, and a pressing portion abutting against the pickup arm, wherein when the pickup arm is moved for the pickup roller to feed the sheets, the pressing portion is pressed by the pickup arm and the stopper is moved and further, the sheet fed by the pickup roller moves the stopper to thereby make the passage of the sheet possible between the pickup arm and the pressing portion.

DETAILED DESCRIPTION OF THE PREFERRED EMBODIMENTS

Some embodiments of the present invention will hereinafter be described in detail with reference to the drawings.

Figure 1:
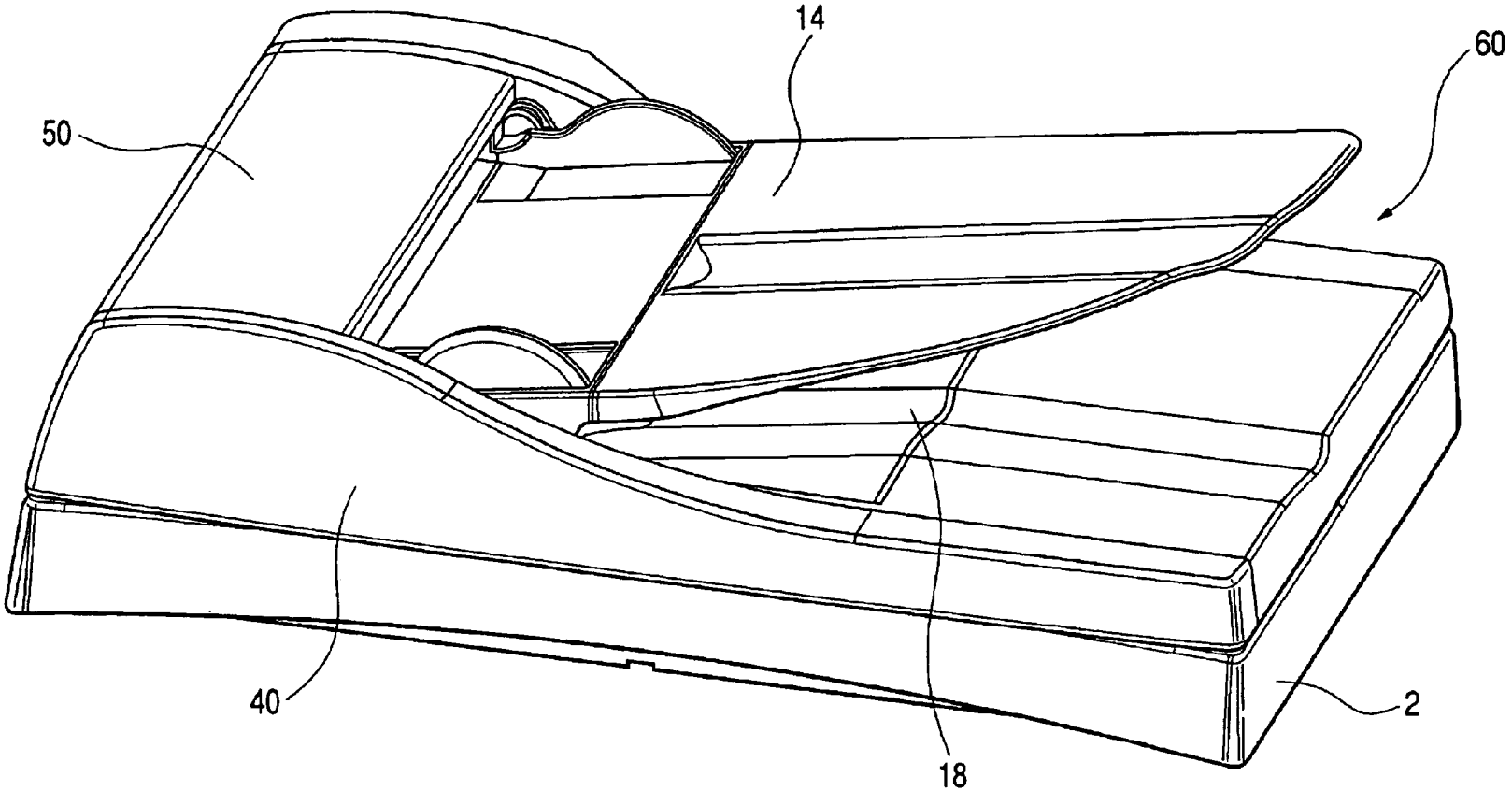
FIG. 1 is a perspective view of an image scanning apparatus provided with a document feeding apparatus having a sheet feeding apparatus according to an embodiment of the present invention.
Figure 2:
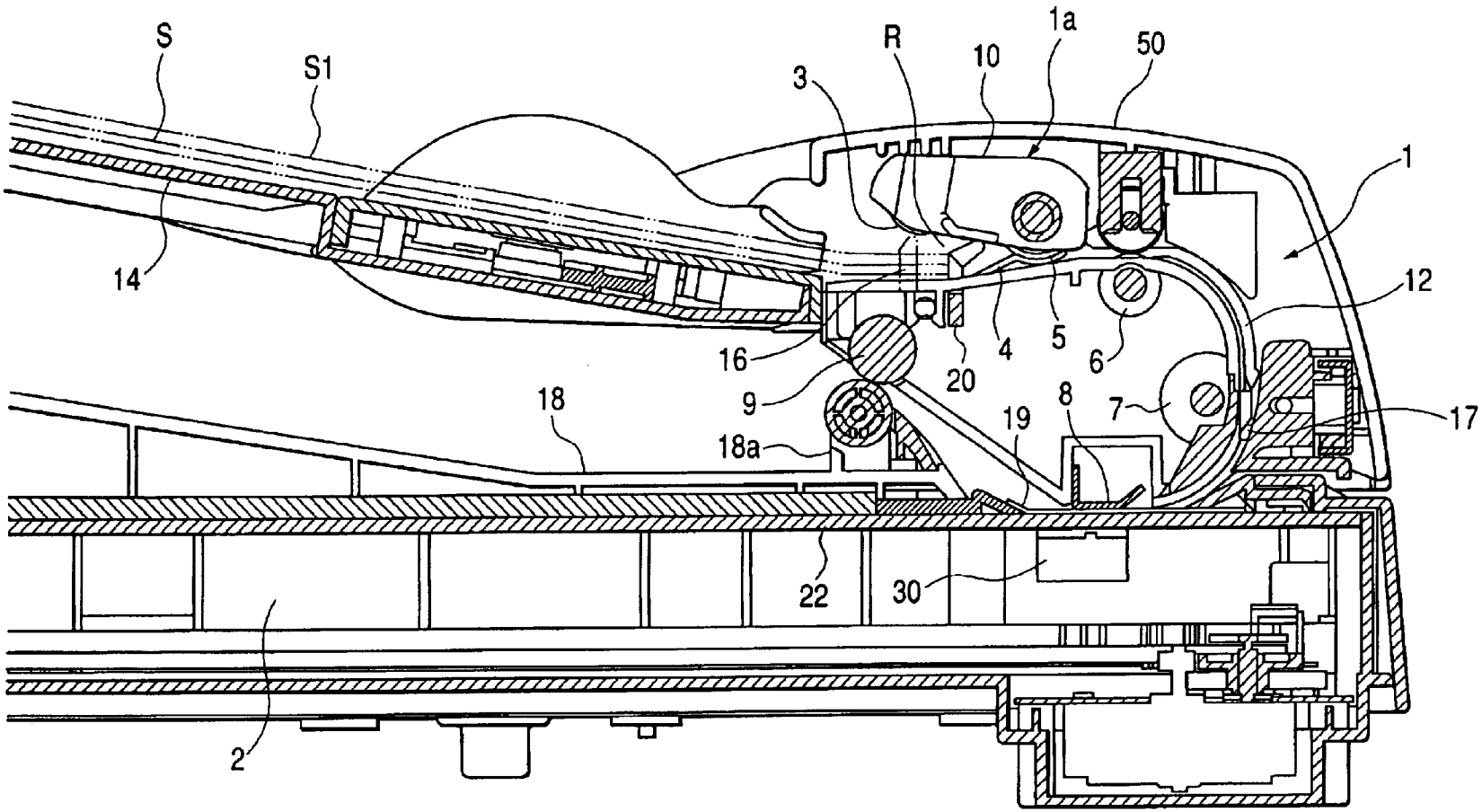
FIG. 2 is a cross-sectional view showing the construction of the image scanning apparatus shown in FIG. 1.

FIG. 1 is a perspective view of an image scanning apparatus provided with a document feeding apparatus having a sheet feeding apparatus according to an embodiment of the present invention, and FIG. 2 is a cross-sectional view showing the construction thereof.

In FIGS. 1 and 2, the reference numeral 60 designates the image scanning apparatus, and the reference numeral 1 denotes the document feeding apparatus mounted on the upper portion of the image scanning apparatus 60. This document feeding apparatus 1 is mounted on the upper portion of the image scanning apparatus 60 for pivotal movement for opening and closing, and is adapted to be closed and hold down a document when the document placed on platen glass 22 is to be scanned.

Also, the reference numeral 40 designates the main body portion of the apparatus acting as a pressure plate for holding down the document on the platen glass 22 when the document feeding apparatus 1 is closed, and a substantially U-shaped document conveying path (hereinafter referred to as the U-turn path) 12 is provided in the interior of the main body portion 40 of the apparatus. A document stacking tray 14 which is sheet supporting means is provided so as to be connected to the upstream end side of the U-turn path 12, and a document discharge tray 18 constituted by a portion of the upper surface of the main body portion 40 of the apparatus is provided so as to be connected to the downstream end side of the U-turn path 12.

A sheet feeding apparatus 1*a* for feeding the documents S which are sheets is provided on the upstream portion of the U-turn path 12, and this sheet feeding apparatus 1*a* is provided with a pickup roller 3 which is sheet feeding means for contacting with the uppermost one S1 of the documents S stacked on the document stacking tray 14 and feeding it, a separation pad 4 constituting separating means for separating the documents S fed by the pickup roller 3 one by one and a separation roller 5 brought into pressure contact with this separation pad 4, and a document presence/absence sensor 16 for detecting the presence or absence of the documents S.

Further, on the downstream end side of the U-turn path 12, there are provided a pair of document discharging rollers 9 for discharging the documents S to the document discharge tray 18, and a document edge sensor 17 for detecting the leading edge portions and trailing edge portions of the documents S.

In FIG. 2, the reference numerals 6 and 7 denote first and second pairs of conveying rollers provided in the U-turns path 12 so as to convey the documents S, the reference character 18*a* designates a document holding surface provided on the base end side of the document discharge tray 18 for holding the trailing edge portions of the documents S being discharged, and the reference numeral 50 denotes an upper cover which is a cover member openably and closably provided in the main body portion 40 of the apparatus, and it is adapted to be opened to remove a jammed document when for example, a document is jammed.

Also, the reference numeral 20 designates a document stopper which is stopper means for abutting against the documents S placed on the document stacking tray 14, and blocking the entry of the documents S into the separating part, and this document stopper 20 is downwardly movably provided in a document feeding path R which is a sheet feeding path along which the documents S fed by the pickup roller 3 pass.

Also, the reference numeral 10 denotes a pickup arm which is holding means pivotally supported above the document stacking tray 14 for rotatably holding the pickup roller 3 and for movement toward and away from the documents S stacked on the document stacking tray 14, and when the documents S are to be fed, this pickup arm 10 is adapted to be downwardly pivotally moved to thereby bring the pickup roller 3 into contact with the documents S. When the pickup arm 10 is thus downwardly pivotally moved, the document stopper 20 is adapted to be depressed as will be described later.

On the other hand, in FIG. 2, the reference numeral 2 designates an image scanning portion for scanning the document placed on the platen glass 22, and this image scanning portion 2 is provided with a close contact type image sensor 30 provided below the platen glass 22 for movement to left and right.

This close contact type image sensor 30 applies light from an LED array as a light source to the image information surface of the document S, images the reflected light reflected from the image information surface on a sensor element by SELFOC lens (trademark) and scans the image information, and it is designed such that when a stationary document is to be scanned, the close contact type image sensor scans the image of the document while moving to left and right (fixed reading made), and when a document conveyed from the document feeding apparatus 1 is to be scanned, it scans the document in a state in which it is stopped at a position shown in FIG. 2 (flow reading mode).

The document feeding apparatus 1 is designed such that when an operator places and sets documents S on the document stacking tray 14, the documents are set from left toward right in a horizontal direction and with the image bearing surfaces thereof facing upwardly, and during this setting of the documents, design is made such that the leading edge position of the documents S is regulated by the document stopper 20 and the presence of the documents is detected by the document presence/absence sensor 16.

When in such an image scanning apparatus 60, the operator instructs to start scanning from an operating part, not shown, a driving part, not shown, is first rotated and the pickup arm 10 is downwardly pivotally moved, whereby the document stopper 20 is depressed by the pickup arm 10. Thereafter, the pickup roller 3 comes into contact with the uppermost one S1 of the documents S stacked on the document stacking tray 14 and feeds this uppermost document S1.

Next, this uppermost document S1 passes the document stopper 20 and is separated from the other documents by the separation roller 5 and the separation pad 4, and is fed into the U-turn path 12. The document S1 thus fed into the U-turn path 12 is conveyed along the U-turn path 12 by the first pair of conveying rollers 6, and is further conveyed by the second pair of conveying rollers 7 toward a scanning position at which the image information is scanned by the close contact type image sensor 30.

Thereafter, when the leading edge portion of the document S1 is detected by the document edge sensor 17, the scanning of the image information by the close contact type image sensor 30 is started when the document S1 has been conveyed by a predetermined amount from that position. At this time, the document S1 is pressed against a reading white ground plate 8. Also, after the start of the scanning, the document S1 is dipped up by a transparent dip sheet 19 and goes toward the pair of document discharging rollers 9.

Next, when the trailing edge portion of the document S1 is detected by the document edge sensor 17, the scanning of the image information by the close contact type image sensor 30 is ended when the document S1 has been conveyed by a predetermined amount from that position. The document S1 of which the scanning has been thus ended is conveyed toward the document discharge tray 18 by the pair of document discharging rollers 9 and is discharged onto the document discharge tray 18.

The discharged document S1 freely falls when the trailing edge portion thereof passes the pair of document discharging rollers 9, and moves along the inclined document discharge tray 18, and soon comes to be contained in the document discharge tray 18 with the trailing edge portion thereof held by a document holding surface 18*a*. In this manner, the image scanning apparatus 60 repeats the above-described scanning operation until the document presence/absence sensor 16 detects the absence of the document.

Figure 3:
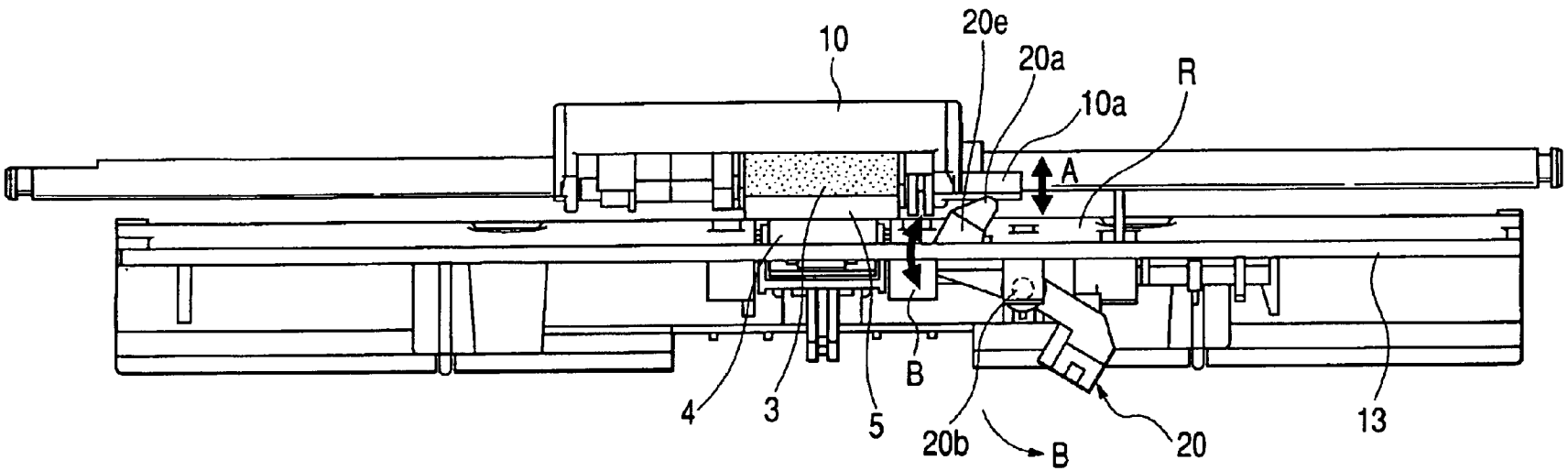
FIG. 3 is a view of the document feeding apparatus shown in FIG. 1 as it is seen from a document stacking tray side.
Figure 4:
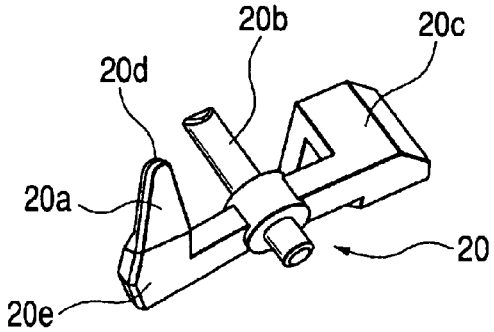
FIG. 4 is a perspective view of a document stopper provided in the document feeding apparatus shown in FIG. 1.
Figure 5A:
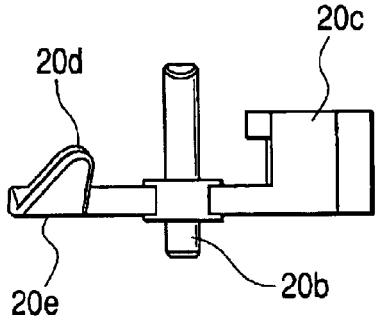
FIG. 5A is a plan view of the document stopper shown in FIG. 4.
Figure 5B:
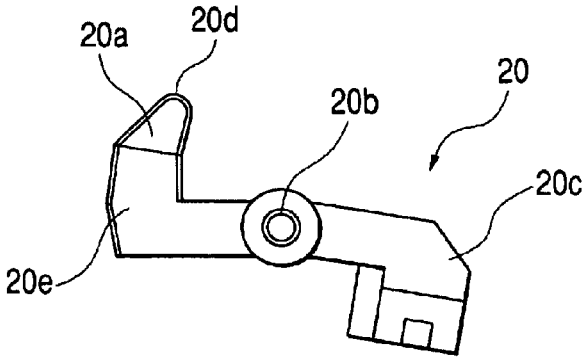
FIG. 5B is a front view of the document stopper.
Figure 5C:
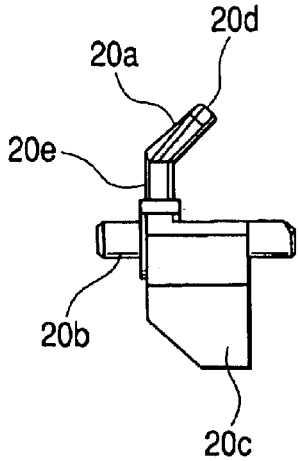
FIG. 5C is a side view of the document stopper.

Now, FIG. 3 is a view of the document feeding apparatus 1 of such a construction as it is seen from the document stacking tray 14, and as shown in FIG. 3, the pickup arm 10 is formed with a pressing piece 10*a* extending sideways to depress the document stopper 20. Also, the document stopper 20 is pivotally mounted on the main body portion 40 of the apparatus and is downwardly movable relative to the document feeding path R. In FIG. 3, the reference numeral 13 denotes an upper guide for guiding the document to the U-turn path 12.

The document stopper 20 will be described here. As shown in FIGS. 4, 5A, 5B and 5C, the document stopper 20 is provided with a document regulating surface 20*e* which is an abutting portion for abutting against the documents placed on the document stacking tray 14 to thereby stop the documents, a pressing portion 20*d* abutting against the pressing piece 10*a* of the pickup arm 10 and being pressed thereby, an inclined portion 20*a* provided between the document regulating surface 20*e* and the pressing portion 20*d*, and a swinging shaft 20*b* for swing ably supporting the document stopper 20.

The document regulating surface 20*e* is disposed so as to be substantially perpendicular to the conveyance direction of the document S, and the inclined portion 20*a* is inclined so as to be located on the downstream side with respect to the feeding direction of the document as it goes from the document regulating surface 20*e* toward the pressing portion 20*d*. Also, the swinging shaft 20*b* is disposed so that the arial direction thereof may be parallel to the conveyance direction of the document substantially at the center of the document stopper 20. Thereby, when the document stopper 20 swings, the document regulating surface 20*e* moves in a state in which it is perpendicular to the conveyance direction of the document, and the inclined portion 20*a* is vertically moved while keeping an angle of inclination.

Figure 6:
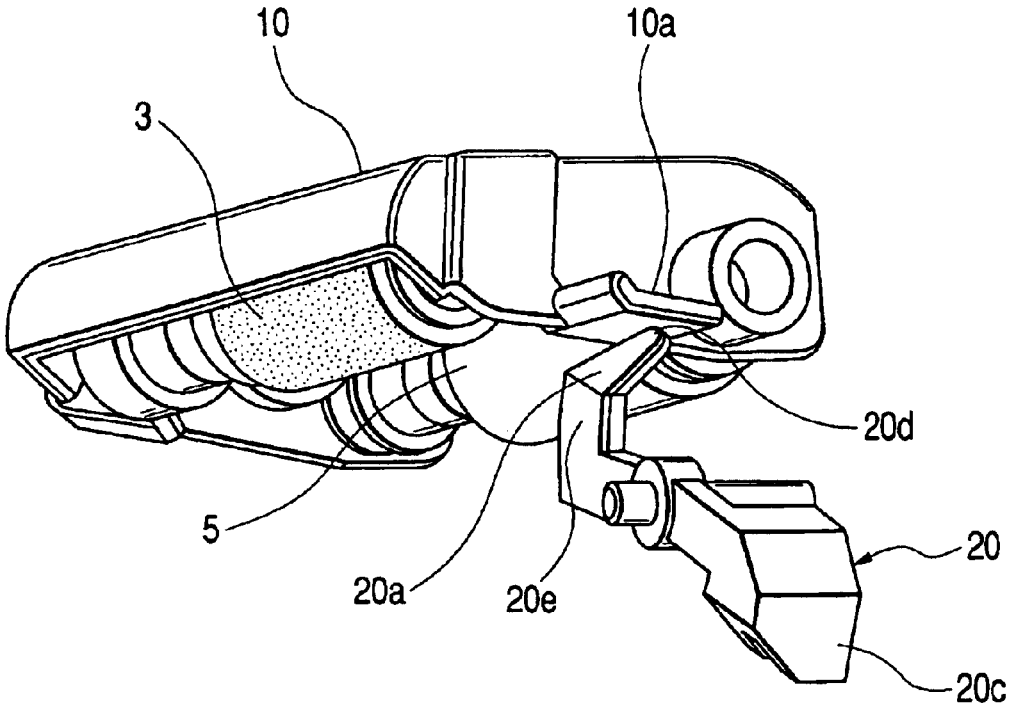
FIG. 6 is a perspective view showing the state when the document stopper shown in FIG. 4 is in a position for blocking the entry of a document into a separating part.

In FIGS. 4, 5A, 5B and 5C, the reference character 20*c* designates a weight portion provided on the opposite side of the pressing portion 20*d* with respect to the swinging shaft 20*b*, and the document stopper 20 is usually inclined with the swinging shaft 20*b* as a fulcrum so that as shown in FIG. 6, the pressing portion 20*b* may be upwardly biased and abut against the pressing piece 10*a* of the pickup arm 10 and the document regulating surface 20*e* may assume a position for blocking the entry of the document into the separating part.

Figure 7A:
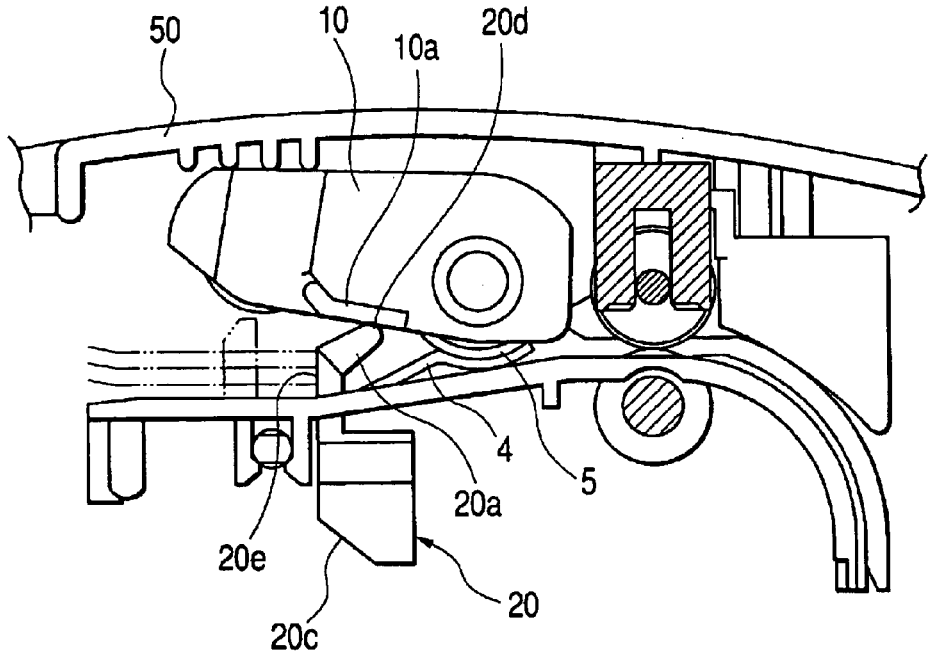
FIG. 7A is a side view showing the state before the document stopper shown in FIG. 4 is depressed.

Description will now be made of the operation of the document stopper 20 constructed as described above. In a standby state, as shown in FIG. 7A, the pickup arm 10 is stopped in its elevated position, and the document stopper 20 is in a state in which the pressing portion 20*d* side thereof is biased by the weight portion 20*c* and abuts against the pressing piece 10*a*. When in this state, the document is inserted, the document S abuts against and is regulated by the document regulating surface 20*e* of the document stopper 20.

When the scanning operation is started and the pickup arm 20 is lowered (downwardly pivotally moved) in the direction of arrow A indicated in FIG. 3, the pressing portion 20*d* is pressed by the pressing piece 10*a* of the pickup arm 10 and swings (descends) in a counter-clockwise direction.

Thereafter, the pickup arm 10 descends until the pickup roller 3 contacts with the document, and therewith, the document stopper 20 swings in a direction orthogonal to the feeding direction of the document indicated by arrow B in FIG. 3 until the pickup roller 3 contacts with the document, and the document regulating surface 20*e* is adapted to be lowered to a predetermined position lower than the document feeding path R.

On the other hand, the document stopper 20 is thus pressed by the pickup arm 10 and descends to a predetermined position, whereafter the pickup roller 3 is rotated, whereupon the documents S are fed and the uppermost document S1 becomes opposed to the inclined portion 20*a* of the document stopper 20 depressed by the pickup arm 10.

Figure 7B:
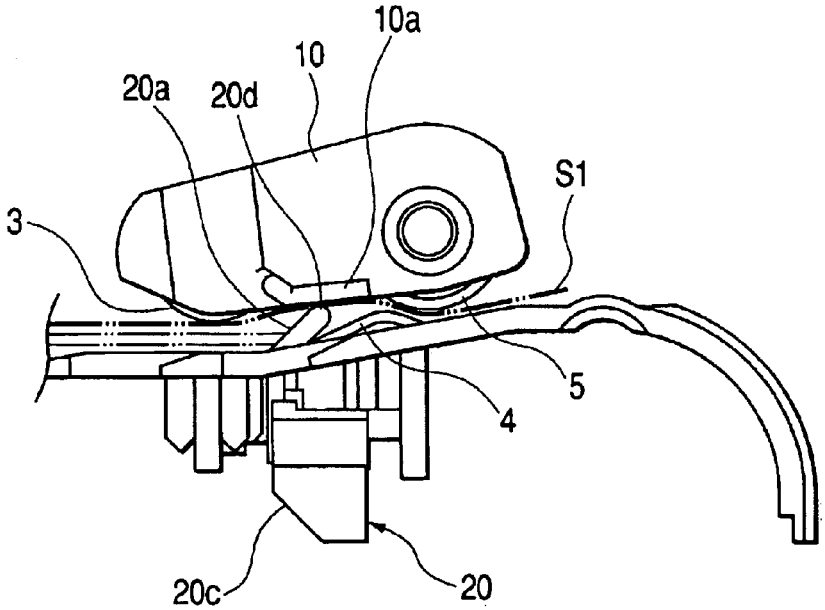
FIG. 7B is a side view showing the state in which a document has entered the separating part while depressing the document stopper.

The uppermost document S1 thus fed by the pickup roller 3 is opposed to the inclined portion 20*a* because the document regulating surface 20*e* is below the document feeding path R. Therefore, the documents S enter the separating part from between the pressing piece 10*a* and the pressing portion 20*d* while pressing and depressing the inclined portion 20*a* of the document stopper 20, as shown in FIG. 7B.

That is, the inclined portion 20*a* is formed on that side of the pressing portion 20*d* contacted by the uppermost document S1 fed by the pickup roller 3 which is adjacent to the document stacking tray, and this inclined portion 20*a* is downwardly pressed by the document S1, whereby the document stopper 20 comes to be lowered.

By design being made such that as described above, during the conveyance of the documents, the document S1 contacts with the document 20 to thereby descend the document stopper 20, or in other words, not to descend the document stopper 20 completely to a position in which it can pass the documents by the pickup arm 10, but by making such design that the document stopper 20 descends to a predetermined position by the pickup arm 10, whereafter the document stopper 20 descends by the document S1, a construction exclusively for lowering the document stopper 20 becomes unnecessary and the construction is simlified and also, the force for descending the document stopper 20 which is required of the pickup arm 10 can be a force as great as the gravity of the document stopper 20 (the weight of the weight portion 20*c*) and therefore, the construction of a driving mechanism, not shown, for driving the pickup arm 10 becomes simple and the cost can be reduced. Further, by the construction of the driving mechanism becoming simple, limitations in installation space, etc. become reducible.

Also, the document stopper 20 is swung in a direction orthogonal to the feeding direction of the documents so as to release the restraint thereof on the documents, whereby it becomes unnecessary to secure a space in the feeding direction of the documents for the document stopper 20, and the downsizing of the apparatus can be achieved.

Thereafter, the feeding of the documents by the pickup roller 3 is ended and the pickup arm 10 is elevated in a direction opposite to the direction of arrow A indicated in FIG. 3 (return pivotal movement), whereupon the document stopper 20 is elevated with the pressing piece 10*a* by gravity (the weight portion 20*c*).

The document stopper 20 is thus elevated by gravity (the weight portion 20*c*) in response to the elevation of the pickup arm 10, whereby it becomes unnecessary to discretely provide driving means for returning the document stopper 20 to its original position for blocking the entry of the documents into the separating part and therefore, the document stopper 20 can be mounted by a very inexpensive and simple construction.

As described above, design is made such that after the document stopper 20 is pressed by the pickup arm 10 with a force as weak as the gravity of the document stopper 20, the document stopper 20 is depressed by the passing document S1, whereby the document stopper 20 can be reliably operated by a simple and low-cost construction.

Figure 8:
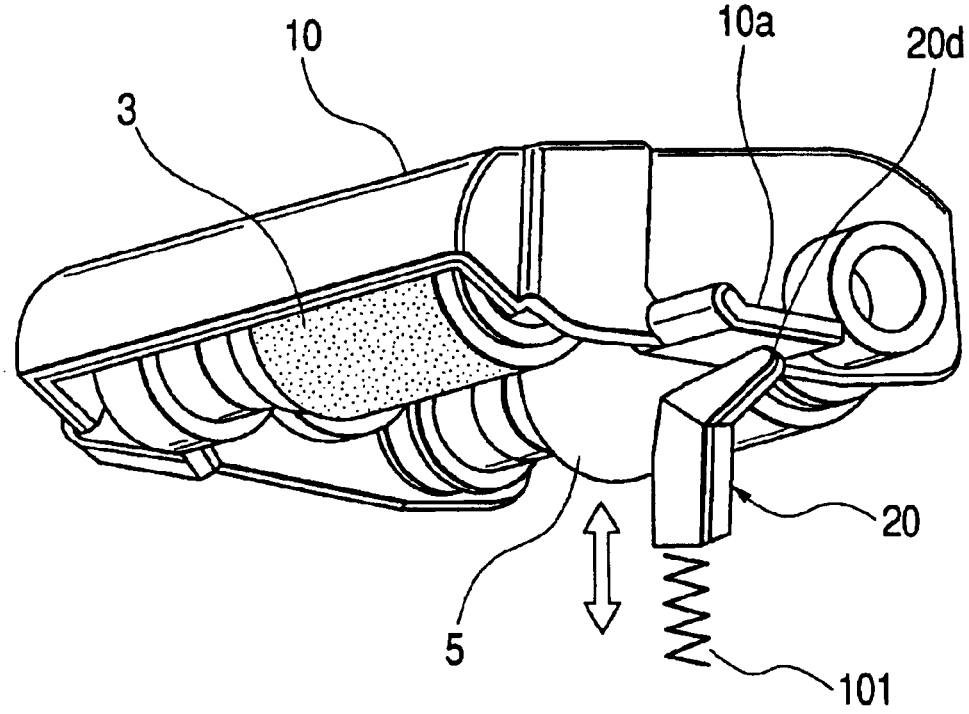
FIG. 8 is a perspective view showing another construction of the document stopper.

Now, while in the foregoing, description has been made of a case where the weight portion 20*c* is provided on the document stopper 20 so that the document stopper 20 may be elevated by the gravity thereof in response to the elevation of the pickup arm 10, the present invention is not restricted thereto, but instead of the weight portion 20*c*, for example, a spring 101 which is a resilient member as shown in FIG. 8 may be used so as to resiliently elevate, for example, the document stopper 20 to thereby bias the pressing portion 20*d* toward the pressing piece 10*a* of the pickup arm 10.

Also, while in the foregoing, description has been made of a construction in which the document stopper 20 is provided only on one of the widthwise sides of the document orthogonal to the feeding direction of the document, the present invention is not restricted thereto, but the document stoppers may be provided on both widthwise sides of the document.

Figure 9:
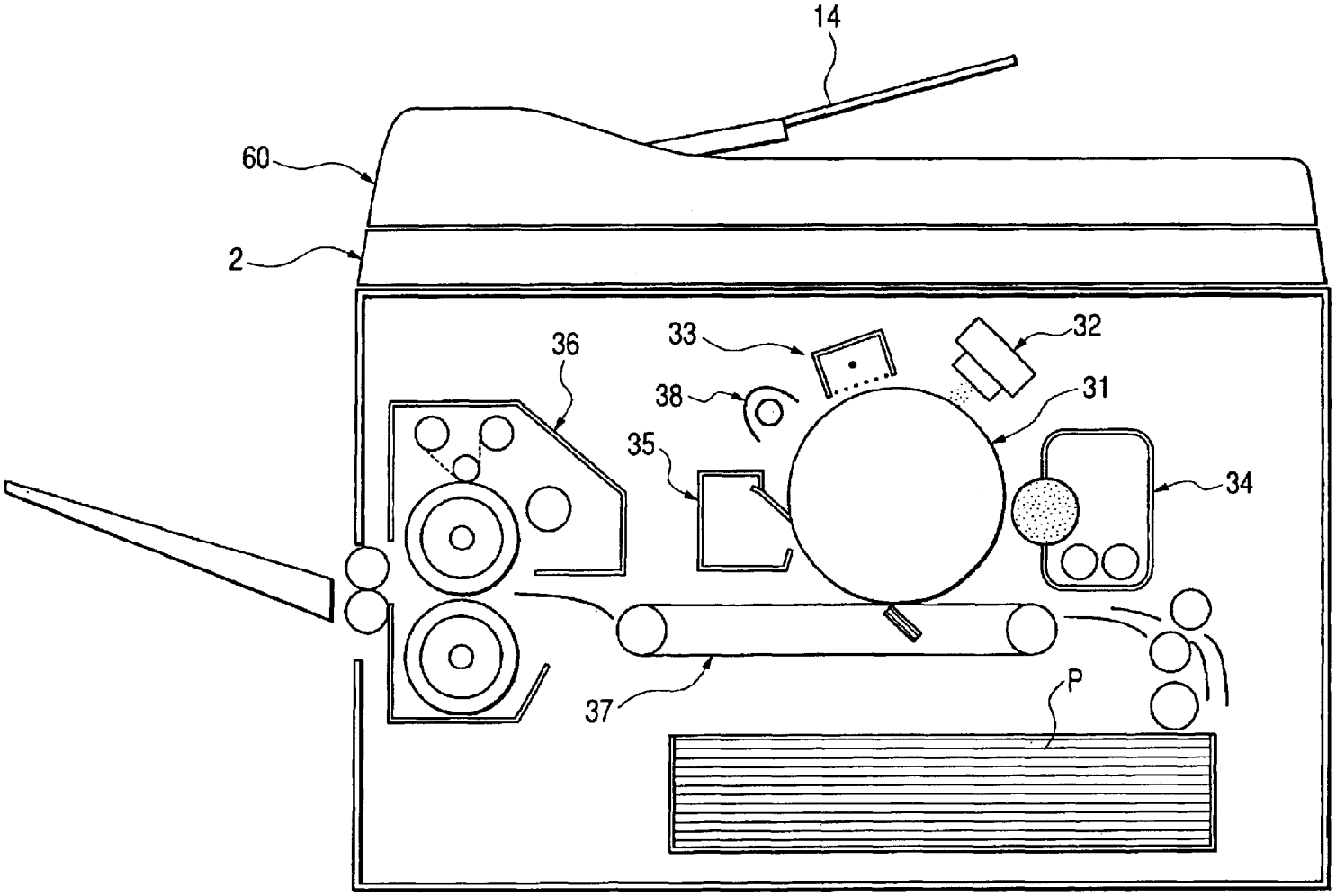
FIG. 9 is a cross-sectional view of an image forming apparatus provided with the image scanning apparatus of the present invention.
Figure 10:
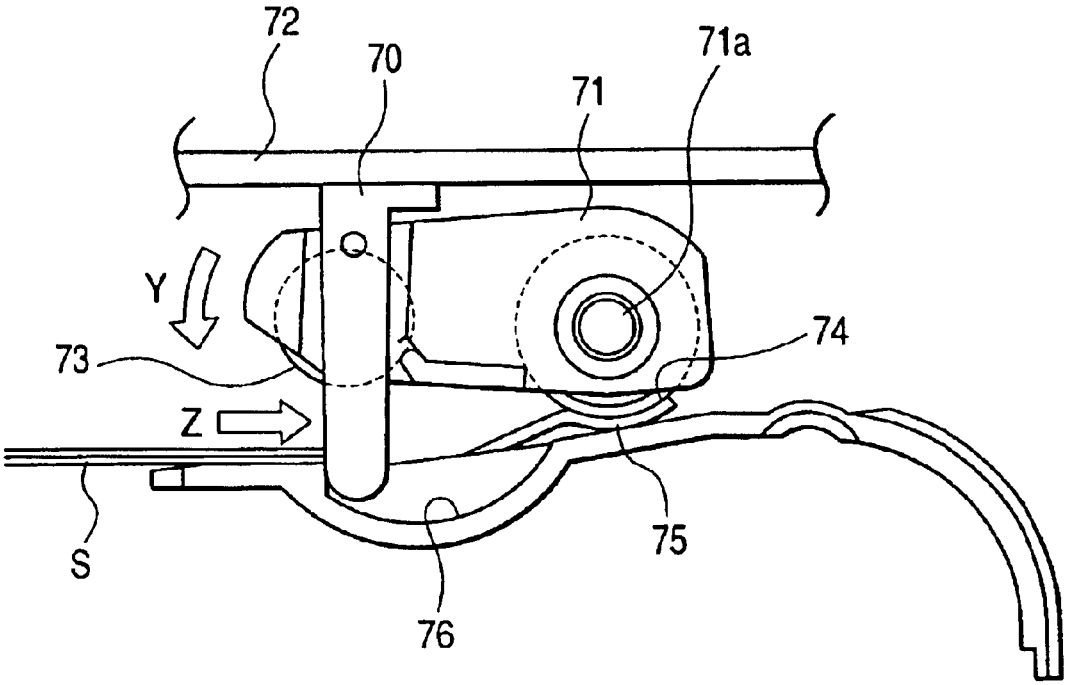
FIG. 10 PRIOR ART
FIG. 10 is a cross-sectional view showing the construction of a conventional sheet feeding apparatus.

An image forming apparatus provided with the image scanning apparatus of the present invention will now be described with reference to FIG. 9.

In the image forming apparatus, when an image scanning start signal is inputted, a photosensitive drum 31 as an image bearing body is charged by charging means 33 so as to assume predetermined potential. On the other hand, in the image scanning apparatus 60 mounted on the upper portion of the image forming apparatus, the scanning of an image on a document is effected in the flow reading mode or the fixed reading mode, and the scanned image signal is sent to the image forming apparatus.

In the image forming part of the image forming apparatus, an electrostatic latent image corresponding to the image on the document is formed on the photosensitive drum 31 by exposing means 32 such as an LED or a laser turned on and off in response to the image signal from the image scanning apparatus 60. Next, this electrostatic latent image is developed by a developing device 34 as developing means containing toner particles therein to thereby obtain a toner image on the photosensitive drum 31.

The toner image formed on the photo-sensitive drum 31 in this manner is electrostatically transferred onto a transferring material P by a transferring apparatus 37. Thereafter the transferring material P is electrostatically separated and is conveyed to a fixing device 36, where the image thereon is heat-fixed and outputted.

After the transfer of the toner image, the surface of the photosensitive drum 31 is subjected to the removal of adhering substances such as any untransferred toner by a cleaner 35 and as required, the exposure by pre-exposing means 38 for removing the optical memory (ghost) of image exposure, and is repetitively used for image formation.

While in the foregoing, description has been made of a case where the sheet feeding apparatus according to the present invention is used as the document feeding apparatus of the image scanning apparatus, the present invention is not restricted thereto, but the sheet feeding apparatus may be used as a document feeding apparatus in an image forming apparatus provided with an image scanning part, a document feeding apparatus for feeding a document to the image scanning part, and an image forming part for forming an image on the basis of document information scanned by the image scanning part.

What is claimed is:

1. A sheet feeding apparatus for feeding sheets supported on sheet supporting means by sheet feeding means, and separating and feeding said fed sheets one by one by separating means, said sheet feeding apparatus comprising:

holding means for moving the sheet feeding means between a sheet feeding position wherein the sheet feeding means abuts against sheets supported on the sheet supporting means and a standby position wherein the sheet feeding means is spaced apart from sheets; and stopper means for abutting against leading edges of sheets supported on the sheet supporting means to thereby block entry of sheets into said separating means, wherein, when said holding means is moved to make said sheet feeding means abut against the sheets supported on said sheet supporting means, said stopper means is pressed and moved by said holding means, and, after said stopper means has been moved by said holding means, said stopper means is pressed by said fed sheets by said sheet feeding means and further moved to thereby make passage to the sheets possible.

2. A sheet feeding apparatus according to claim 1, wherein said stopper means comprises:

an abutting portion against which the leading edges of the sheets supported on said sheet supporting means abut to thereby block entry of the sheets into said separating means;

a pressing portion pressed by said holding means when said holding means is moved to move said sheet feeding means to said sheet feeding position; and an inclined portion against which the sheets fed by said sheet feeding means abut when said pressing portion is pressed and moved by said holding means, wherein the sheets strike against said inclined portion, whereby said stopper means is further moved to thereby make the passage of the sheets possible.

3. A sheet feeding apparatus according to claim 2, wherein said stopper means, when pressed by said holding means, is moved to a position in which said abutting portion retracts from a position for blocking the sheets.

4. A sheet feeding apparatus according to claim 2, wherein said stopper means, when said holding means is moved to move said sheet feeding means to said standby position, is moved to a position for blocking entry of the sheets into said separating means in operative association with said holding means.

5. A sheet feeding apparatus according to claim 4, wherein said stopper means is swingably supported, and has a weight portion for biasing said pressing portion toward said holding means to follow movement of said holding means.

6. A sheet feeding apparatus according to claim 4, wherein said stopper means is swingably supported, and is provided with resilient means for biasing said pressing portion toward said holding means to follow movement of said holding means.

7. A sheet feeding apparatus according to claim 5 or 6, wherein said stopper means is supported for swinging movement in a direction orthogonal to a sheet feeding direction.

8. An image scanning apparatus for feeding documents supported on document supporting means by document feeding means, separating and feeding said fed documents one by one by separating means, and scanning the images on said fed documents by document scanning means, said image scanning apparatus comprising:

holding means for holding said document feeding means for movement between a document feeding position wherein the document feeding means abuts against the documents supported on said document supporting means and a standby position wherein the document feeding means is spaced apart from the documents; and stopper means for abutting against leading edges of documents supported on the document supporting means to thereby block entry of documents into said separating means;

wherein, when said holding means is pivotally moved to make said document feeding means abut against the documents supported on said document supporting means, said stopper means is pressed and moved by said holding means, and, after said stopper means has been moved by said holding means, said stopper means is pressed by said fed documents by said document feeding means and is further moved to thereby make passage of the documents possible.

9. An image forming apparatus for feeding documents supported on document supporting means by document feeding means, separating and feeding said fed documents one by one by separating means, scanning images on the fed documents by document scanning means, and forming an image on a transferring material by image forming means on basis of document information scanned by said document scanning means, said image forming apparatus comprising:

holding means for holding said document feeding means for movement between a document feeding position wherein the document feeding means abuts against the documents supported on said document supporting means and a standby position wherein the document feeding means is spaced apart from the documents; and stopper means for abutting against leading edges of documents supported on document supporting means to thereby block entry of documents into said separating means;

wherein, when said holding means is pivotally moved to make said document feeding means abut against the documents supported on said document supporting means, said stopper means is pressed and moved by said holding means, and, after said stopper means has been moved by said holding means, said stopper means is pressed by said fed documents by said document feeding means and is further moved to thereby make passage of the documents possible.

10. A sheet feeding apparatus for feeding sheets placed on a sheet stacking tray by a pickup roller, and separating and feeding the fed sheets one by one by a separation roller and a separation pad, said sheet feeding apparatus comprising:

a pickup arm having said pickup roller mounted thereon and for moving said pickup roller between a sheet feeding position wherein the pickup roller contacts with the sheets supported on said sheet stacking tray and a standby position wherein the pickup roller is spaced apart from the sheets; and a stopper for abutting against leading edges of sheets supported on said sheet stacking tray to block entry of sheets into said separation pad;

wherein said stopper is provided with an abutting portion against which the leading edges of the sheets supported on said sheet stacking tray abuts, and a pressing portion abutting against said pickup arm, and when said pickup arm is moved for said pickup roller to feed the sheets, said pressing portion is pressed by said pickup arm and said stopper is moved and further, the sheets fed by said pickup roller move said stopper to thereby make the passage of the sheets possible between said pickup arm and said pressing portion.

11. A sheet feeding apparatus according to claim 10, wherein an inclined portion is provided between said abutting portion and said pressing portion, and the sheets fed by said pickup roller strike against said inclined portion to thereby move said stopper, and said sheets pass between said pickup arm and said pressing portion.

12. A sheet feeding apparatus according to claim 10, wherein said stopper is swingably supported, and said pressing portion is biased by a weight portion so as to abut against said pickup arm.

13. A sheet feeding apparatus according to claim 10, wherein said stopper is swingably supported, and said pressing portion is biased by a spring so as to abut against said pickup arm.

14. A sheet feeding apparatus according to claim 10, wherein said stopper is provided for appearing and disappearing in a sheet feeding path between said sheet stacking tray and said separation pad, and when it is pressed and moved by said pickup arm, said abutting portion retracts from said sheet feeding path and said inclined portion is positioned in said sheet feeding path.

15. An image scanning apparatus for feeding documents placed on a document stacking tray by a pickup roller, separating and feeding the fed documents one by one by a separation roller and a separation pad, and scanning images on the fed documents by document scanning means, said image scanning apparatus comprising:

a pickup arm having said pickup roller mounted thereon and for moving said pickup roller between a document feeding position wherein the pickup roller contacts with the documents supported on said document stacking tray and a standby position wherein the pickup roller is spaced apart from the documents; and a stopper for abutting against leading edges of documents supported on said document stacking tray to block entry of documents into said separation pad;

wherein said stopper is provided with an abutting portion against which the leading edges of the documents supported on said document stacking tray abut, and a pressing portion abutting against said pickup arm, and when said pickup arm is moved for said pickup roller to feed the documents, said pressing portion is pressed by said pickup arm and said stopper is moved and further, said fed documents by said pickup roller move said stopper to thereby make the passage of the documents possible between said pickup arm and said pressing portion.

16. An image forming apparatus for feeding documents placed on a document stacking tray by a pickup roller, separating and feeding the fed documents one by one by a separation roller and a separation pad, scanning images on the fed documents by document scanning means, and forming an image on a transferring material by image forming means on the basis of document information scanned by said document scanning means, said image forming apparatus comprising:

a pickup arm having said pickup roller mounted thereon and for moving said pickup roller between a document feeding position wherein the pickup roller contacts with the documents supported on said document stacking tray and a standby position wherein the pickup roller is spaced apart from the documents; and a stopper for abutting against leading edges of documents supported on said document stacking tray to block entry of documents into said separation pad;

wherein said stopper is provided with an abutting portion against which the leading edges of the documents supported on said document stacking tray abut, and a pressing portion abutting against said pickup arm, and when said pickup arm is moved for said pickup arm, and when said pickup arm is moved for said pickup roller to feed the documents, said pressing portion is pressed by said pickup arm and said stopper is moved and further, said fed documents by said pickup roller move said stopper to thereby make the passage of the documents possible between said pickup arm and said pressing portion.

* * * * *

UNITED STATES PATENT AND TRADEMARK OFFICE

CERTIFICATE OF CORRECTION

PATENT NO. : 6,792,241 B2
DATED : September 14, 2004
INVENTOR(S) : Daigo Nakagawa et al.

It is certified that error appears in the above-identified patent and that said Letters Patent is hereby corrected as shown below:

Title page,
Item [57], ABSTRACT,
Line 4, “press” should read -- presses --.
Line 8, “ascents” should read -- ascends --.

Column 7,
Line 15, “simlified” should read -- simplified --.

Column 12,
Line 19, “and” should be deleted.
Line 20, “when said pickup arm is moved for said pickup arm,” should be deleted.

Signed and Sealed this

Eleventh Day of January, 2005

JON W. DUDAS
*Director of the United States Patent and Trademark Office*